United States Patent [19]

Charters et al.

[11] 3,989,588

[45] Nov. 2, 1976

[54] APPARATUS FOR PRODUCING KRAFT TYPE PULP

[75] Inventors: Michael T. Charters; Franklin F. Landis, both of Springfield, Ohio

[73] Assignee: The Bauer Bros. Co., Springfield, Ohio

[22] Filed: Feb. 10, 1975

[21] Appl. No.: 548,288

Related U.S. Application Data

[62] Division of Ser. No. 456,455, April 1, 1974, Pat. No. 3,873,412.

[52] U.S. Cl. ..... 162/234; 162/236; 162/261

[51] Int. Cl.[2] ..... B32B 9/04

[58] Field of Search ..... 162/236, 234, 235, 261, 162/19, 25, 28, 26

[56] References Cited

UNITED STATES PATENTS

| | | | |
|---|---|---|---|
| 2,947,655 | 8/1960 | Eberhardt | 162/236 |
| 3,411,720 | 11/1968 | Jones et al. | 162/236 |

*Primary Examiner*—Robert L. Lindsay, Jr.
*Assistant Examiner*—George C. Yeung
*Attorney, Agent, or Firm*—Jerome P. Bloom

[57] ABSTRACT

Apparatus for producing pulp for use in the manufacture of kraft type products such as linerboard and bag grade paper comprising means for steaming small segments of fibrous material and defiberizing the same in a pressurized atmosphere and at an elevated temperature, means for mixing the defiberized material, while still hot, with hot kraft pulp and means connected to receive and then refine the mixture so obtained.

12 Claims, 5 Drawing Figures

Figure 1:
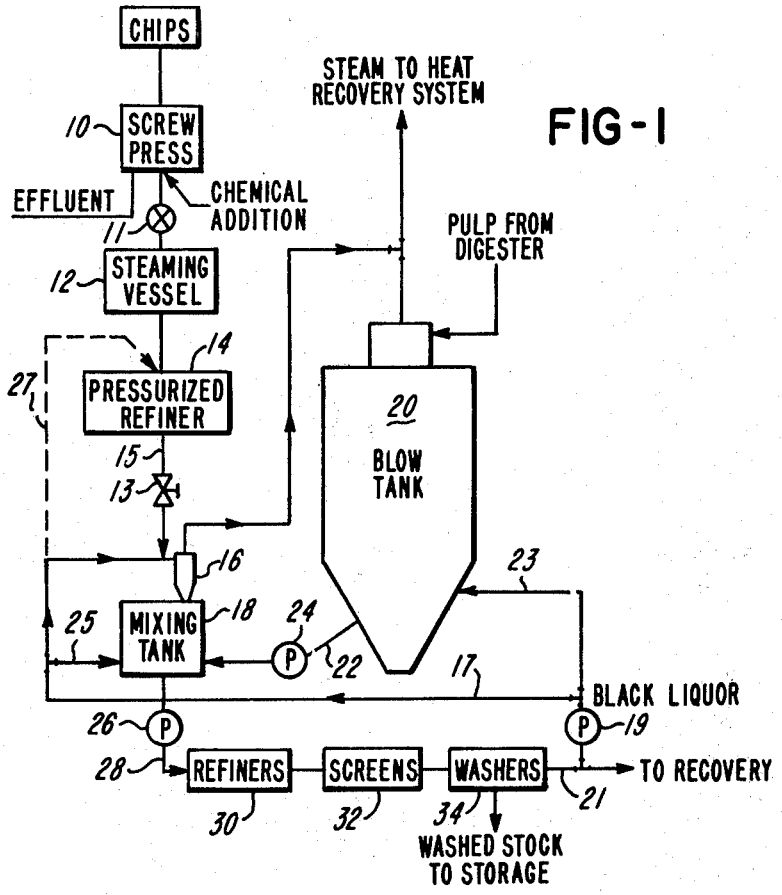

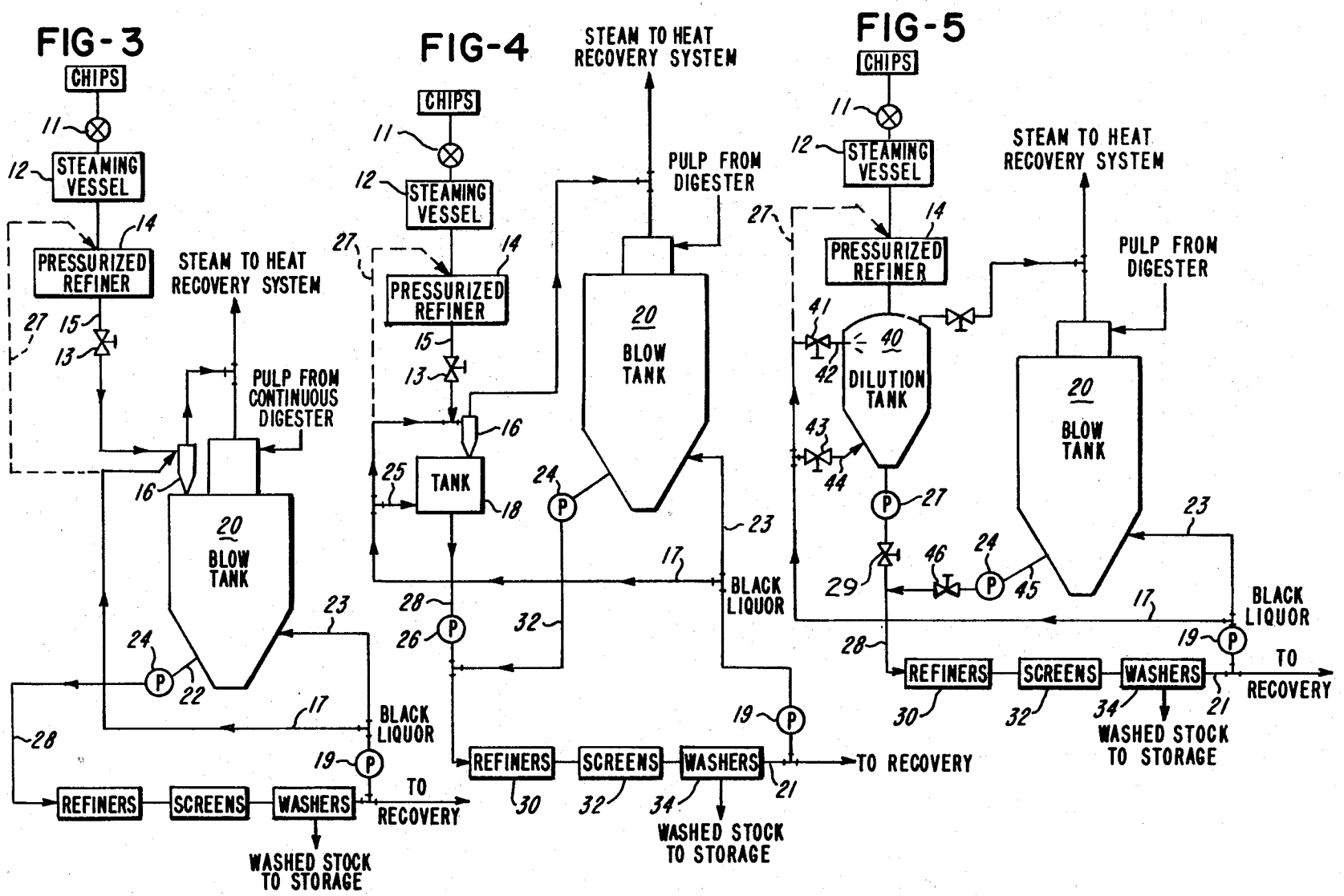
FIG-5
CHIPS
STEAMING VESSEL
PRESSURIZED REFINER
DILUTION TANK
BLOW TANK
PULP FROM DIGESTER
STEAM TO HEAT RECOVERY SYSTEM
BLACK LIQUOR
TO RECOVERY
WASHERS
SCREENS
REFINERS
WASHED STOCK TO STORAGE
FIG-4
CHIPS
STEAMING VESSEL
PRESSURIZED REFINER
TANK
BLOW TANK
PULP FROM DIGESTER
STEAM TO HEAT RECOVERY SYSTEM
BLACK LIQUOR
TO RECOVERY
WASHERS
SCREENS
REFINERS
WASHED STOCK TO STORAGE
FIG-3
CHIPS
STEAMING VESSEL
PRESSURIZED REFINER
BLOW TANK
PULP FROM CONTINUOUS DIGESTER
STEAM TO HEAT RECOVERY SYSTEM
BLACK LIQUOR
TO RECOVERY
WASHERS
SCREENS
REFINERS
WASHED STOCK TO STORAGE

APPARATUS FOR PRODUCING KRAFT TYPE PULP

This is a division of application for U.S. Letters Patent, Ser. No. 456,455, filed Apr. 1, 1974 and entitled APPARATUS AND PROCESS FOR PRODUCING KRAFT TYPE PULP, now U.S. Pat. No. 3,873,412.

BACKGROUND OF THE INVENTION

This invention relates to a new and unique system and apparatus for producing a relatively low cost, high quality pulp for use in making kraft type products such as linerboard and bag grade paper.

The kraft pulp industry has been beset with many problems. A basic and continuing problem is the ever increasing cost of production. However, this problem is overshadowed by the more serious problem that the supply of wood of the quality normally required for the production of kraft pulp is limited. Efforts to heretofore find a satisfactory solution have met with little success.

SUMMARY OF THE INVENTION

The present invention not only provides means for extending the available supply of pulp for kraft type products but also enables a substantial reduction in the cost of producing such a pulp and improves its quality.

Embodiment of the invention provides an arrangement of apparatus enabling a pulping process featuring the mixture of defiberized wood chips, which may be derived from a variety of waste type materials, with a conventional kraft stock. In a use of a preferred embodiment of the invention, the wood chips either in a raw or weakly impregnated condition, are steamed, pressure refined in a disc refiner, and, while still hot, mixed with hot kraft pulp and hot black liquor. In the course of and as a consequence of this mixture, the lignin which coats the disc refined fibers is reacted with the unused chemicals remaining in the black liquor. The composite fiber mixture so obtained can then be conventionally refined and screened and washed either before or after refining.

The equipment and controls of the invention system are so arranged as to minimize the production of steam and the use of chemical liquors. The net result is the enabling of a most economical and effective procedure for providing a homogeneous pulp mixture eminently suited for use in making high quality kraft type products which have improved strength characteristics.

A primary object of the invention is to provide improvements in systems and apparatus for producing a quality pulp suited for use in making kraft type products such as linerboard and bag type paper.

Another object of the invention is to provide improvements in pulp refining installations enabling the production of a kraft quality pulp product derived from woods not normally accepted or workable as kraft materials.

A further object of the invention is to provide means for making kraft quality pulp which are economical to employ, more efficient and satisfactory in use and adaptable to a wide variety of applications.

An additional object of the invention is to provide means for producing a new pulp suitable for use in kraft type products possessing the advantageous features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Figure 2:
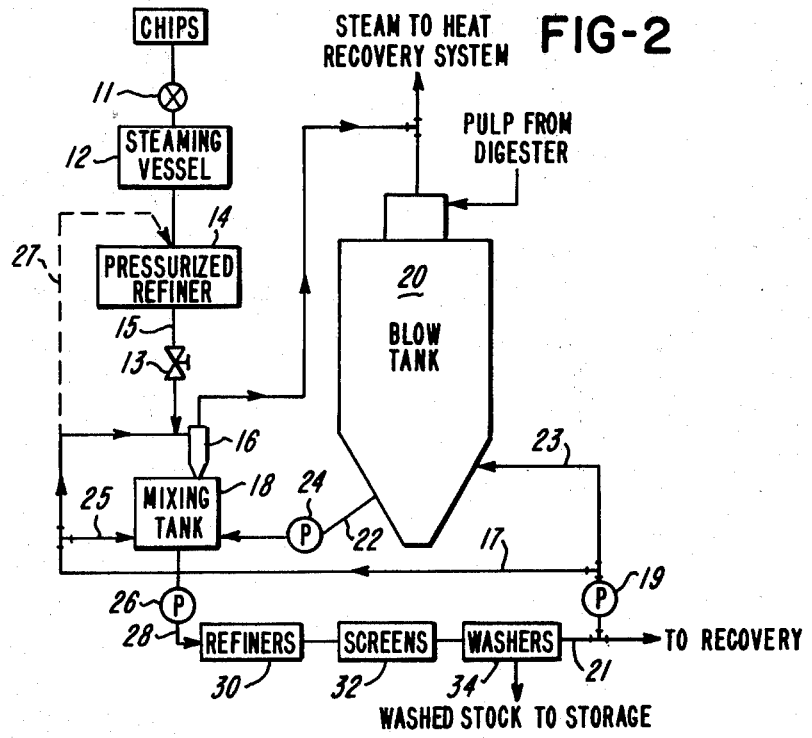

Referring to the accompanying drawings wherein is shown one but obviously not necessarily the only form of embodiment of the invention, FIG. 1 is a diagrammatic showing of a preferred pulp producing installation embodying the concepts of the present invention;

FIG. 2 shows a modification of the installation illustrated in FIG. 1; and FIGS. 3–5 diagrammatically illustrate further modifications of the installation of FIG. 1 which employ basic concepts of the present invention.

Like parts are indicated by similar characters of reference throughout the several views.

The invention system and the apparatus thereof illustrated in FIG. 1 of the accompanying drawings include, in part and in series relation, a screw press 10, a steaming vessel 12, a disc type refiner 14, a centrifugal separator 16 and a mixing tank 18.

A blow tank 20 is connected to receive hot kraft stock and attendant black liquor from a batch type digester (not shown) and to discharge such stock to the mixing tank 18 by way of a conduit 22. The latter incorporates a pump 24, the control of which will determine the rate of feed of the hot kraft stock and black liquor to the tank 18.

A pump 26 is incorporated in a conduit 28 which connects at its entrance end to the mixing tank 18. The discharge end of the conduit 28 connects to a disc type refiner 30 which is in a series relation with a screen 32 and a washer 34. There may be one or more series related refiners 30, screens 32 or washers 34. This will depend on the particular application of the invention system.

In the utilization of the system of FIG. 1, raw wood chips, which may be derived from what is normally considered as scrap or waste materials, are first fed into the screw press 10. In the case illustrated, a conventional screw press may be employed but it is preferred that the press 10 be one such as known as an "Impressafiner", a product manufactured by The Bauer Bros. Co. of Springfield, Ohio, U.S.A. In the "Impressafiner" the wood chips are successively compressed and expanded to remove resins and contained liquids and partially defiberized by this procedure. Then, at the discharge end of the press, the pressed chips are subjected to an application of a small amount of liquid conditioning chemical, the nature of which depends on the desired physical characteristics of the end product sought. The conditioning chemical employed may be NaOH, $Na_2S$, NaOH + $Na_2S$, $Na_2Sx$ (polysulfide), or the like. The fact that the chips readily expand in the presence of liquor after they leave the pressure zone of the press contributes to a most effective pre-treatment of their fiber content.

Free of extracted effluent, the pre-treated chips are then moved through a pressure sealing valve 11 to the steam chamber defined in the vessel 12. The chips are retained in the steam chamber for a period of two to ten minutes during which they are continuously advanced to a discharge station from which they are directed to the inlet of the disc refiner 14. In the preferred embodiment illustrated the refiner 14 will provide a pressurized environment for the partially defiberized and pre-conditioned chips. It is noted that a double revolving disc refiner is preferred, though a single disc refiner will function satisfactorily for some applications of the invention system and process. In passing through the steam chamber in the vessel 12 the chips will be subjected to elevated pressures from 10 to 150 p.s.i.g. and correspondingly to elevated temperatures and at consistencies from 15 to 40 %. A similar environment will prevail in the refiner 14 as the chips are passed between opposed refiner discs (not shown), one of which revolves relative the other.

Under influence of the discs and the pressurized conditions in the refiner 14, maintained by the provision of a valve 13 in a discharge line 15 extending from the refiner to the tangential inlet of the centrifugal separator 16, the chips are converted primarily into individual fibers coated with lignin and small fiber bundles loosely held together by a lignin bond. As the chips are reduced, the resultant fibers and fiber bundles and attendant free liquor are blown past the valve 13 to the inlet of the separator 16. Entering the inlet of the separator 16 together with these fibers is a measured amount of blank liquor delivered by way of a conduit 17 and through the medium of a pump 19. The suction side of pump 19 connects with a liquor recovery line 21 which connects in turn with the washer or washers 34 at the end of the invention system. The liquor will cause the pulp fibers which enter the separator to assume a dilute slurry form.

For best results, the temperature of the liquor introduced to the separator should be maintained between 140° F. and 212° F. It is most important for best performance to keep the temperature of the liquor within the separator close to 212° F., to insure an optimal reaction on the fibers by the residual chemicals in the hot black liquor and the maintenance of the fibers at an elevated temperature during and after the conventional cyclone separating procedure in the separator 16.

By keeping the liquor at the noted temperature level heat is retained and the production and escape of steam minimized. Such steam as is produced is directed from the overflow end of the separator to a heat recovery system (not shown).

Accordingly, the fibers produced in the refiner 14 are further chemically treated in the separator 16 by hot black liquor which moves therewith from the underflow end of the separator to the mixing tank 18.

As noted previously, the blow tank 20 is connected with a digester containing a batch of conventional kraft pulp. Once the kraft materials in the digester are properly digested, the resultant pulp stock is delivered to the blow tank. The temperature of this stock and that in the mixing tank 18 is controlled by the delivering of metered amounts of hot black liquor. This liquor has its source in the liquor recovery line 21 and is furnished under the influence of pump 19 through branches 23 and 25 of the conduit 17. As noted in FIG. 1, a branch 27 of conduit 17 can be used to supply black liquor to the refiner 14, if so desired.

As they reach the tank 18, the pressure refined fiber products originating in the refiner 14 will be continuously mixed with the hot kraft pulp. The latter is delivered from the blow tank 20 at a uniform rate so as to achieve a desired proportion of conventional kraft pulp to the disc refined pulp. As will be obvious the mixing takes place in the presence of hot black liquor, the temperature of which, as noted previously, is kept close to 212° F. It is significant that the pressure refined pulp will essentially be individual fibers so that they are continuously exposed to the residual chemical in the hot black liquor and the reaction thereon by the chemical will be continuous throughout the entire process.

The proportion of the disc refined pulp mixed with the conventional hot kraft pulp will preferably be controlled so that it will be between 5% and 25% of the total pulp production. The amounts combined will depend on the required end product strength, bulk, brightness, printability, stiffness, etc. Practice indicates that the most practical pulp produced per the invention will have a disc refined fiber content of 10% to 15%. It appears at this time that if this disc refined fiber content is increased to 25%, a new line of kraft type products will be enabled by the present invention.

To point out the benefits of the invention as to yield and savings, reference is had to the following illustration of the economics of using a mixture of 10% pressure refined pulp fibers and 90% kraft type pulp in a 1000 ton per day kraft type linerboard mill.

Assume the following conditions:

| | |
|---|---|
| Kraft Pulp Yield | 55% |
| Pressure Refined - Black Liquor treated Pulp Yield | 90% |
| Raw Wood required for 1,000 Tons of 55% Yield Kraft Pulp | 1,818 Ton |
| Raw Wood required for 900 Tons of 55% Yield Kraft Pulp | 1,636 Ton |
| Raw Wood required for 100 Tons of 90% Refined Pulp | 111 Ton |
| Raw Wood required for 1,000 Tons of Mixed Pulp | 1,747 Ton |
| Wood Savings Per Day using 10% Refined Pulp | 71 Ton |

The resulting savings of 71 ton of wood per day represents a 3.9% wood savings. At a wood cost of $23 per ton, this represents a yearly (350 days) savings of approximately $571,000. Higher percentages of high yield pulp would, of course, increase the saving in wood usage.

The high black liquor temperatures employed per the invention not only improve the conditioning of the pressure refined fibers but they also improve the economics of operating evaporators in a conventionally associated chemical recovery system.

Thus, by reason of the invention, the problem of a limited supply of the raw materials normally required for producing kraft pulp is considerably diminished, if not eliminated. Moreover the cost of producing a pulp capable of use for kraft type products has become significantly reduced. Add to this the high quality of this newly conceived homogeneous pulp mixture and the net result is a substantial advantage to and advance in the pulping art and installations therefor.

FIG. 2 of the drawings shows an installation which is identical to that shown in and described with reference to FIG. 1 except that the screw press 10 and the pre-impregnation procedure effected therein is eliminated. Here the raw chips will be first steamed and the rest of the procedure will be as previously described. The system will be completely adequate for preparing pulp for use in kraft type products. This is due to the fact the chemical reaction enabled by use and application of hot black liquor as described is highly effective to control the physical characteristics of the desired end product.

FIG. 3 shows a modification of the system of FIG. 1 wherein the screw press 10 and mixing tank 18 are both eliminated. In this system the centrifugal or cyclone separator 16 is so placed that its underflow end discharges the disc refined materials in the form of fibers chemically treated by hot black liquor, as previously described, directly to the blow tank 20.

In this embodiment of the invention the rate of feed of hot kraft pulp from the kraft digester to the blow tank 20 will be maintained at a uniform level. As the disc refined chemically treated fibers flow into the hot kraft pulp, an automatic mixture will inherently take place. A continuous cooking effect results as the residual chemicals in the black liquor in the blow tank react on the intermixed fibers. In this case the black liquor should be kept at a temperature in the range from about 140° F. to 250° F.

The embodiment of FIG. 3 is not preferred since the control factors are not as well defined as in the other described embodiments of the invention. However, the resultant pulp will be well suited for lesser quality kraft type products and advantages of the basic concept of the invention are still retained.

It is noted that where the kraft pulp is produced in a system which discharges the cooked pulp at atmospheric pressure, the conventional blow tank 20 would not be required for steam separation. In such case the kraft pulp could be discharged, in a metered flow, directly to the mixing tank 18 where the same may be used in the practice of the present invention.

The system of FIG. 4 of the drawings differs from that of FIG. 2 only in that the hot kraft stock is not combined with the disc refined stock in the tank 18 but in the course of a merging flow in the conduit 28. In this case conduit 22 is eliminated and replaced by a conduit 32 which directs the hot kraft stock from the blow tank 20 to the discharge conduit 28 at a point immediately following a pump 26. The latter is incorporated in the conduit 28 to induce a pressured flow of stock from the tank 18 to the following disc refiner 30. Thus, as disc refined stock, diluted by hot black liquor in the tank 18, is drawn from the mixing tank and moved with the hot liquor, under pressure, to the refiner 30, the hot kraft stock is discharged into the body thereof by way of the conduit 32 and so mixed in the course of a continuous flow. In the course of the movement of this mixture to and through the disc refiner 30, the liquor content, still hot, continues to react on the disc refined fibers. The process and equipment employed in the system of FIG. 4 is otherwise as previously described.

The installation of FIG. 5 of the drawings differs from that of FIG. 4 in that the cyclone separator 16 and the mixing tank 18 have been eliminated and replaced by a dilution tank 40. In this embodiment of the invention the delivery line 17, which carries hot black liquor, is provided with two branches 42 and 44 which connect the line with the tank 40. The branches 42 and 44 embody control valves 41 and 43 and are connected to respectively discharge into the upper and lower ends of the tank 40.

With a system so modified as shown in FIG. 5, the fiber stock created in the refiner 14, as previously described, is discharged directly to the tank 40 wherein pressure is carefully controlled. In this instance black liquor of a proper temperature must be introduced to the case of the refiner 14, in the course of the disc refining procedure, in an amount sufficient to cause condensation of most of the steam which may occur during the refining operation. This will obviate the need for a separator 16 in following relation to the disc refiner. In the tank 40 which constitutes a dilution tank, the disc refined fibers are embodied in a body of hot black liquor to which liquor may be added, as required, below the level of the liquid in the tank, by way of the branches 42 and 44. With this arrangement there is a controlled consistency of the material in the tank 40 and the heat lost as steam is reduced to a minimum. Utilizing the pump 27, the dilute slurry form of the disc refined fibers which have been reacted with hot liquor in the dilution tank is channeled to the conduit 28 to be flowed therethrough under pressure. A control valve 29 is incorporated in the conduit 28 in a following relation to the pump 27. In the embodiment of FIG. 5 the blow tank 20 is connected to the conduit 28 by way of a conduit 45 in which is incorporated the pump 24 followed by a control valve 46. The discharge end of the conduit 45 connects into the conduit 28 immediately following the valve 29. It may thus be seen that in this embodiment of the invention there is a metered control of the disc refined stock as well as a metered control of the hot kraft stock. The respective disc refined stock and hot kraft stock may thus be caused to merge in a continuing flow in the conduit 28 following the valve 29 and in proportions which may be precisely arranged. The so merged portions of the respective stocks will be thoroughly intermixed in the course of flow and there will be a continuing reaction of the hot black liquor forming part of the flow of the disc refined fibers which is continued as the fibers and the hot kraft stock are intermixed in a further refining procedure in a disc refiner or refiners 30.

Of course, as in each described embodiment of the invention, this last described disc refining is followed by screening and washing of a suitable and conventional nature. The resultant stock mixture, as washed, is directed to storage and/or immediately forwarded for further use while the hot black liquor remaining after washing is recovered and transmitted from the washers by way of a line 21 into which is connected the hot liquor delivery line 17.

In this last described embodiment of the invention it may be necessary to bleed some steam from the top of the tank 40 in order to control the pressure in this tank and within the case of the disc refiner 14. The mechanics of this are believed quite obvious and need not be specifically described.

From the foregoing it will be clear that the invention provides apparatus so related as to enable a simple but unique process of extending conventional kraft stock which results in a high quality pulp usable for a great variety of kraft type products. Not only are economies inherent in the system and answers to problems which have been prevalent in the art as described, but the invention appears to have developed the possibility of new products which are basically kraft type products.

Various installations have been suggested to embody the invention concept and illustrated in generally descending order of preference. The differences in the installations as here proposed are with a practical recognition of the fact that differences in available equipment or the nature of the end product desired may make it more reasonable or suitable that one installation may be preferred in preference to others.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for producing a pulp suited for use in the manufacture of kraft type products comprising means for receiving and elevating the temperature of segments of fibrous material, pressurized refiner means connected to receive said material the temperature of which has been elevated, said pressurized refiner means embodying means to reduce said material to individual fibers and fiber bundles, means for providing a hot kraft pulp, means for effecting an intermingling of said individual fibers and fiber bundles and said hot kraft pulp and means for applying hot black liquor to the fibers and fiber bundles and said hot kraft pulp to produce in the intermingling thereof a composite pulp mixture especially suited for kraft type products.

2. Apparatus as in claim 1 characterized by said temperature elevating means being provided by a steaming vessel and said reducing means being provided by a disc type refiner in series relation with said steaming vessel.

3. Apparatus as in claim 2 wherein means receiving the disc refined material connected in following relation to said disc refiner and in preceding relation to said intermingling means has in connection therewith means for applying hot black liquor to the fibers and fiber bundles therein prior to passage thereof to said intermingling means.

4. Apparatus as set forth in claim 2 wherein a centrifugal separator is arranged in series and in following relation to said disc refiner and means are connected therewith for an application therein of hot black liquor with the disc refined material to be jointly subjected therewith to a centrifugal separating action therein prior to intermingling of the hot kraft pulp with the disc refined fibrous material.

5. Apparatus as in claim 4 characterized by said centrifugal separator being connected to discharge the centrifugally separated disc refined fibrous material and attendant hot black liquor to a blow tank for the intermingling of said disc refined material with said hot kraft pulp in said blow tank and further refiner means being connected in following relation to said blow tank to further refine the composite mixture of said disc refined fibrous material and said hot kraft pulp.

6. Apparatus as in claim 2 characterized by a further vessel following said disc refiner to receive the disc refined material, said further vessel having, in connection therewith, means to apply hot black liquor therein to have the chemical content thereof react on said disc refined material and to cause said material to maintain an elevated temperature, and a further refiner following said second vessel and connected thereto by conduit means and means in connection with one of said further vessel and said conduit means to deliver therein said hot kraft pulp for mixture thereof with the hot disc refined material prior to said disc refined material reaching said further refiner.

7. Apparatus as set forth in claim 4 wherein said intermingling means includes a mixing tank connected in following relation to said centrifugal separator to receive therefrom the disc refined material and said mixing tank has means in connection therewith for delivery thereto of the hot kraft pulp and further disc refiner means in following relation to said mixing tank to receive therefrom the composite of the disc refined material and hot kraft pulp and to refine the same as a composite mixture.

8. Apparatus for producing a pulp suited for use in the manufacture of kraft type products including means for delivering hot kraft pulp, means for delivering defibered pulp, means for commonly receiving and inducing a mixing of said hot kraft pulp and the defibered pulp and means connected to introduce hot black liquor for the intermixture thereof with said hot kraft pulp and defibered pulp to produce a composite pulp mixture especially suited for kraft type products.

9. Apparatus according to claim 8 characterized by means for controlling the proportions of hot kraft pulp and defibered pulp delivered to said mixing means to limit the amount of defibered pulp mixed with the hot kraft pulp to be in a proportion of 5% to 25% of the total pulp delivered for conventional kraft stock preparation.

10. Apparatus according to claim 9, wherein said means for delivering defibered pulp includes in series relation a steaming vessel and a pressurized refiner so that the defibered pulp delivered to mix with the hot kraft pulp is comprised of hot pressure refined fibers.

11. Apparatus according to claim 10 characterized in that said receiving and mixing means includes a mixing tank into which said hot pressure refined fibers and hot kraft pulp are introduced and means are connected to provide for the introduction of hot black liquor into said mixing tank.

12. Apparatus for producing a pulp suited for use in the manufacture of kraft type products, comprising a steam pressurized means for receiving raw wood chips and raising the temperature thereof, pressurized refiner means for receiving the chips the temperature of which has been raised, said pressurized refiner means embodying therein means for separating the chips into individual fiber segments, a vessel connected in following relation to said pressurized refiner means to receive therefrom said individual fiber segments, said vessel having in connection therewith means for introducing and applying hot kraft black liquor to said segments under conditions of elevated pressure and temperature, means for providing hot kraft pulp having in connection therewith means for directing said pulp into means providing a path for delivery of said fiber segments from said vessel to produce thereby a composite mixture consisting of the hot kraft pulp, the said fiber segments and the hot kraft black liquor especially suited for use in kraft type products.

* * * * *

UNITED STATES PATENT AND TRADEMARK OFFICE

CERTIFICATE OF CORRECTION

PATENT NO. : 3,989,588

DATED : November 2, 1976

INVENTOR(S) : Michael T. Charters; Franklin F. Landis

It is certified that error appears in the above-identified patent and that said Letters Patent are hereby corrected as shown below:

Col. 3, line 25, "blank" is corrected to read -- black --.

Col. 6, line 32, "of" (second occurrence) is corrected to read -- on --.

Signed and Sealed this

Eighth Day of March 1977

[SEAL]

*Attest:*

RUTH C. MASON
*Attesting Officer*

C. MARSHALL DANN
*Commissioner of Patents and Trademarks*